US006457746B1

(12) United States Patent
Schepers

(10) Patent No.: US 6,457,746 B1
(45) Date of Patent: Oct. 1, 2002

(54) SNOWBOARD TETHER

(76) Inventor: John Schepers, 1353 Gordon Street, Guelph, Ontario (CA), N1L 1C9

( * ) Notice: Subject to any disclaimer, the term of this patent is extended or adjusted under 35 U.S.C. 154(b) by 0 days.

(21) Appl. No.: 09/810,613

(22) Filed: Mar. 19, 2001

(51) Int. Cl.[7] ..... A63C 11/00
(52) U.S. Cl. ..... 280/809
(58) Field of Search ..... 280/14.21, 14.22, 280/14.23, 14.24, 809, 814, 816, 637, 606; D21/774

(56) References Cited

U.S. PATENT DOCUMENTS 3,062,585 A * 2/1962 Bentley
3,854,739 A * 12/1974 Toda et al. ..... 280/606
5,026,088 A 6/1991 Stuart
5,137,483 A * 8/1992 Nealy ..... 441/75
5,564,729 A 10/1996 Gomez et al.
5,623,842 A * 4/1997 Davridge ..... 70/18
5,857,682 A * 1/1999 Hyman ..... 280/14.2
5,904,056 A 5/1999 Ozaki
5,951,048 A 9/1999 Slaughter
5,957,741 A * 9/1999 Evans ..... 441/75
6,089,592 A * 7/2000 Negus ..... 280/620
6,290,260 B1 * 9/2001 Brill ..... 280/809
6,349,968 B1 * 2/2002 Crego et al. ..... 280/809

FOREIGN PATENT DOCUMENTS

FR 2383682 * 11/1978
FR 2677261 * 12/1992

* cited by examiner

*Primary Examiner*—Brian L. Johnson
*Assistant Examiner*—Bryan Fischmann
(74) *Attorney, Agent, or Firm*—Ridout & Maybee LLP

(57) ABSTRACT

A snowboard tether for supporting a snowboard during a chair-lift ride and permitting the user to harness his or her back foot to the snowboard during the course of the chair-lift ride. A fastener attached to the snowboard allows the user to connect a strap to the fastener prior to sitting upon the chair-lift. The user may then attach the strap to the chair-lift, causing the strap to support the rear of the snowboard and permitting the user to exert downward force with his or her foot upon the rear binding of the snowboard. The fastener incorporates a storage container.

14 Claims, 3 Drawing Sheets

SNOWBOARD TETHER

BACKGROUND OF THE INVENTION

This invention relates to the sport of snowboarding. More specifically, the invention relates to a snowboard tether for supporting the snowboard during a chair-lift ride and permitting the user to harness his or her back foot to the snowboard during the course of the chair-lift ride.

Winter sports facilities are witnessing a dramatic increase in participation in the sport of snowboarding. A snowboard is a surfboard-like runner that includes a substantially flat board with a slippery bottom surface. Unlike a surfboard, on a snowboard the user attaches his or her feet to bindings that are affixed to the upper surface of the board.

Snowboards are typically used at winter sports facilities, like ski resorts, that have traditionally catered to skiers. The most prevalent mechanism for transporting the skiers or snowboarders to a high elevation at the resorts is a chair-lift. This mechanism, originally designed for skiers, typically involves a succession of bench seats suspended from a cable and pulley system that transports the benches from a bottom point to an elevated point and back again. At the bottom point, the skiers wait in turn to use the chair-lift mechanism. As each bench reaches the bottom point and turns around the pulley to advance up to the elevated point, the bench is positioned relatively close to the ground, enabling a skier to sit onto the bench. When the bench reaches the skiers, the skiers sit upon the bench, which is then whisked up to the elevated point by the cable and pulley system. At the elevated point, the mechanism is designed such that the skiers' skis make contact with the ground and they can alight from the bench by standing up and pushing away.

To use the chair-lift, a snowboarder must detach his or her back foot in order to position himself or herself in front of an advancing bench. The bottom point of the chair-lift is typically a flat surface requiring manual force to propel oneself In some cases, the bottom point can involve icy portions or inclines upon which a snowboarder needs to maintain a fixed position, for instance, while positioned in front of an advancing bench. In these circumstances, the snowboarder also needs a foot in contact with the ground to prevent the snowboard from sliding out of position.

Accordingly, a snowboarder must mount the chair-lift with only the front foot attached to the bindings on the snowboard and with the back foot dangling free. Because snowboards can weigh a substantial amount, considerable downward force is experienced by the front leg of the snowboarder. This weight causes stress and fatigue that reduces the snowboarder's endurance and ability to fully enjoy the sport.

Furthermore, at the elevated point of the chair-lift, the snowboarder must alight from the bench with only one foot attached to the snowboard. This necessitates the re-harnessing of the back foot to the binding before the snowboarder can resume snowboarding. This not only wastes time, but can cause congestion at the elevated point of the chair-lift as a number of snowboarders must stop their forward movement to re-harness their back feet. Congestion can lead to frustrations and collisions.

These problems could be alleviated by permitting a snowboarder to re-harness his or her back foot to the snowboard during the course of the chair-lift ride. Currently, a snowboarder is unable to re-harness his or her back foot because the center of gravity of the snowboard is between the front and back bindings on the snowboard. When the snowboarder's front foot is the only attachment point, the weight of the snowboard exerts a torsional force on the front foot forcing the rear portion of the snowboard downwards. To harness the back foot, a snowboarder is required to apply substantial force through his or her back foot onto the rear binding of the snowboard. Without additional support for the rear portion of the snowboard, the snowboard cannot absorb that substantial force.

If the snowboarder were to attempt to provide the necessary support to the rear of the snowboard manually by grasping the rear portion with one hand, there exists a substantial danger that the snowboarder would fall forward off the chair lift. Almost all chair lifts incorporate a safety bar which can be manually rotated from a position directly in front of the snowboarders on the bench to a position above the snowboarders' heads. When in front of the snowboarders, the safety bar prevents the snowboarders from accidentally falling forward off the chair during the ride. However, the safety bar also prevents the snowboarders from leaning forward to grasp the rear portion of their snowboards.

A number of leash or tether devices have been developed over the years in connection with snowboards for the purpose of securing the snowboard to the user in the event they become separated during a fall. These devices have typically involved a leash attached to the snowboard and around the front leg of the user. The front leg serves as the leashing point in these devices because the front leg remains in the binding, whereas the back leg must be released from time to time to permit propulsion over flat ground. These devices are designed for use while riding the snowboard, necessitating an arrangement of the leash secure to the user's leg so as to prevent the leash cord from becoming entangled in tree branches or other protrusions during use of the snowboard.

These devices are inappropriate for use in supporting the snowboard to permit re-harnessing of the back foot because the leash or tether in these devices is attached at or near the front binding and does not prevent the torsional force exerted upon the front foot by the weight of the snowboard or the applied force of the back foot. Moreover, because the leash is intended for use while riding the snowboard, it must be tightly secured to the front leg of the snowboarder with a minimum of slack so as to prevent tangling or snagging of objects. Such an arrangement does not allow for translation of torsional forces through the leash to the chair-lift.

A number of these devices also involve an excessive number of components, rendering them expensive, cumbersome, unattractive and difficult to operate under winter conditions.

In order to permit a snowboarder to easily insert his or her back foot into the rear binding during a chair-lift ride, a device is needed that provides support for the rear portion of the snowboard such that the snowboarder is permitted to exert downward force upon the rear binding. Moreover, the device should provide support for the weight of the snowboard during the remainder of the chair-lift ride.

Such a device needs to be easily manipulated by a user wearing bulky handwear, such as thick mittens, and with a minimum of bending or effort. The device should be inexpensive and easy to assemble and attach to existing snowboards. The device needs to have a minimum number of parts, be easily operable and be easily carried when not in use. It also needs to be designed such that the snowboard retains its operating flexibility.

It would be advantageous if such a device could incorporate other useful functions. Space for mounting items on a snowboard is limited, so it is important to maximize the functions that can be incorporated into a single mounted piece. In particular, it would be useful if the device could also act as a carrying strap for the snowboard, as carrying a snowboard can be awkward and cumbersome. Carrying multiple snowboards is much easier if each snowboard has a carrying strap.

It would also be useful if the device could provide storage for items that a snowboarder would like to carry with him or her. When solid bulky items are carried in the snowboarder's clothing, they can cause injury when the snowboarder falls upon them. Therefore, it would be advantageous if the mounting piece incorporated a storage element.

BRIEF SUMMARY OF THE INVENTION

The prevent invention provides a snowboard tether that supports the rear of the snowboard during the course of a chair-lift ride so as to enable a snowboarder to re-harness his or her back to the snowboard and to provide support for the weight of the board during the ride. Additionally, it operates as a carrying strap and provides storage for personal belongings.

The present invention comprises a fastener affixed to the upper face of the rear portion of the snowboard and a strap. The strap comprises a length of material with manually releasable attachment devices affixed to either end. One of the manually releasable attachment devices is for connection to the fastener and the other manually releasable attachment device is for securing the strap to the chair lift. Through the strap, the chair-lift then supports the rear of the snowboard allowing the snowboarder to exert downward force upon the rear binding with his or her back foot.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Reference will now be made, by way of example, to the accompanying drawings which show preferred embodiments of the present invention, and in which:

FIG. 3(*b*) shows a cross-sectional view of a fastener according to the present invention, taken generally along the line b—b in FIG. 3(*a*);

FIGS. 3(*c*) and (*d*) show a fastener according to the present invention;

FIG. 6(*d*) shows an exploded perspective view depicting the assembly of the storage element shown in FIG. 6(*a*).

DETAILED DESCRIPTION OF THE PREFERRED EMBODIMENTS

Figure 1:
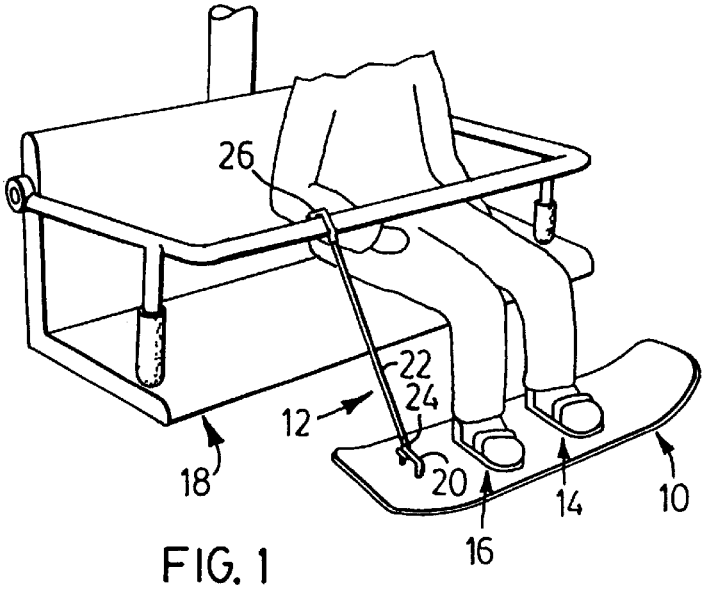
FIG. 1 shows a perspective view of a snowboard tether according to the present invention in use in conjunction with a snowboard and a chair-lift.
Figure 3B:
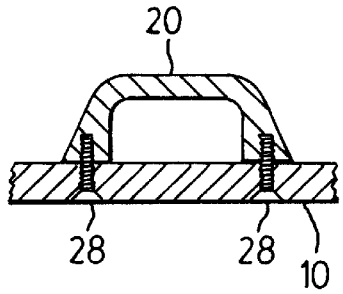
FIG. 3(*a*) shows a fragmentary perspective view of a fastener according to the present invention, affixed to a snowboard.

Reference is first made to FIG. 1 which shows, in perspective view, a snowboard tether 12 in use in conjunction with a snowboard 10 and a chair-lift 18. The snowboard tether 12 comprises an inverted U-shaped fastener 20, a length of non-elastic material 22, a first hook 24 for engaging the fastener 20 and a second hook 26 for engaging the chair-lift 18.

Attached to the snowboard 10 are a front foot binding 14, a back foot binding 16 and the fastener 20. The fastener 20 is located towards the rear of the snowboard 10, behind the front and back foot bindings 14 and 16.

The snowboard user mounts the chair-lift with his or her front foot harnessed to the snowboard 10 by the front foot binding 14 and his or her back foot unharnessed to the snowboard 10. The snowboard user applies the snowboard tether 12 by engaging the first hook 24 with the fastener 20. The snowboard user may engage the first hook 24 with the fastener 20 prior to mounting the chair-lift 18 or after mounting the chair-lift 18.

After the snowboard user has mounted the chair-lift 18 and engaged the first hook 24 with the fastener 20, the snowboard user engages the second hook 26 with the chair lift 18, such that the snowboard tether 12 exerts an upward force upon the rear end of the snowboard 10. Alternatively, a user may wrap the length of non-elastic material 22 around a fixed portion of the chair-lift 18 and engage the second hook 26 with the length of non-elastic material 22, thereby securing the snowboard tether 12 to the chair-lift 18. With the snowboard tether 12 in place, the snowboard user is able to apply downwards pressure with his or her back foot upon the back foot binding 16 because the snowboard is supported by the snowboard tether 12 and the snowboard user's front foot.

Prior to the end of the chair-lift ride, the snowboard user detaches the second hook 26 from the chair-lift 18. The snowboard user may detach the first hook 24 from the fastener 20 prior to dismounting the chair-lift 18 or shortly thereafter. The first and second hooks 24 and 26 are manually releasable devices, meaning that the snowboard user can manually detach them from the snowboard and chair-lift, respectively, by hand without using any tools.

Figure 2:
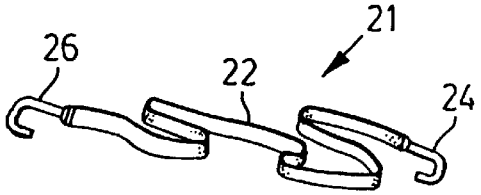
FIG. 2 shows a perspective view of a strap according to the present invention.
Figure 3C:
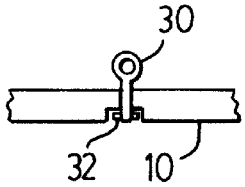
Figure 3A:
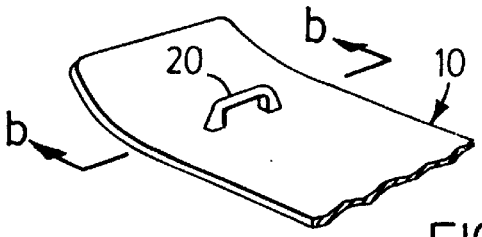
Figure 3D:
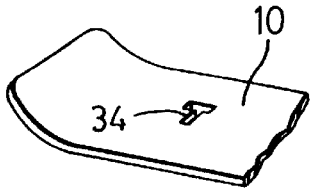

Reference is now made to FIG. 2 which shows a strap 21 comprising a length of substantially non-elastic material 22 (such as a nylon web), a first hook 24 attached to one end of the length of material 22 and a second hook 26 attached to the other end of the length of material 22.

Reference is next made to FIGS. 3(*a*) and (*b*), wherein an embodiment of the fastener 20 is depicted. The fastener 20 is affixed to the rear portion of the snowboard 10 with counter-sunk screws 28 that have been inserted from the underside of the board 10 through screw holes. An alternative for affixing the fastener 20 to the snowboard 10 is top mounted screws in conjunction with threaded inserts which are molded into the snowboard 10 during manufacture of the snowboard. Various other well-known fastening alternatives could be used for affixing the fastener 20 and will be apparent to those skilled in the art. Likewise, various alternative fasteners 20, such as eye-bolts or t-slots, will be apparent to those skilled in the art. An eye-bolt is depicted in FIG. 3(*c*) wherein the fastener 20 is comprised of an eye-bolt 30 and a nut 32. A t-slot is depicted in FIG. 3(*d*) wherein the fastener 20 is comprised of a t-shaped slot 34 of rigid material molded into the snowboard 10.

Figure 4A:
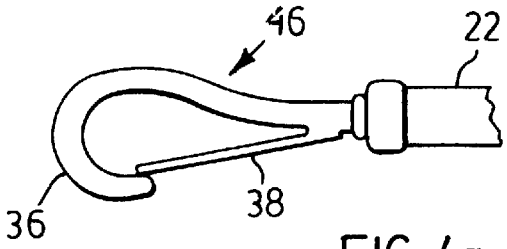
FIGS. 4(*a*), (*b*) and (*c*) show side views of alternative embodiments of a manually releasable attachment device according to the present invention.
Figure 4B:
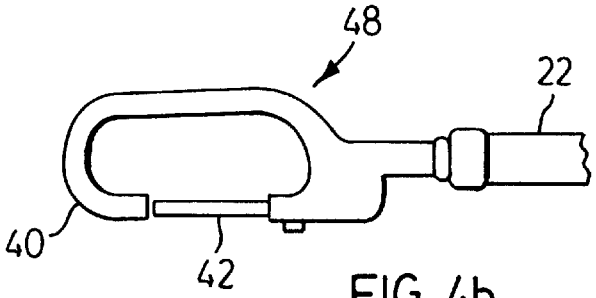
Figure 4C:
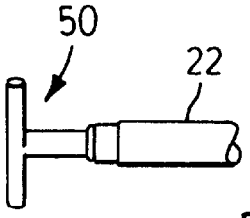

Referring next to FIGS. 4(*a*), (*b*) and (*c*), alternatives to the first and second hooks 24 and 26 are depicted. The first or second hook 24 or 26 could comprise a hinged clip 46, including a rigid hook-shaped portion 36 and a hinged portion 38 biased to engage the hook-shaped portion 36. The hinged portion 38 would normally be positioned in a closed position in contact with the hook-shaped portion 36, but would be easily manually swung to an open position to allow the passage of objects through the gap between the hook-shaped portion 36 and the hinged portion 38.

Alternatively, the first or second hook 24 or 26 could comprise a spring clip 48, including a rigid hook-shaped hook-shaped portion 40 and a sliding portion 42 biased to engage the hook-shaped portion 40. The sliding portion 42 would normally be positioned in a closed position in contact with the hook-shaped position 40, but would be easily manually slid to an open position to allow the passage of objects through the gap between the hook-shaped portion 40 and the sliding portion 42. The spring-biased closure portions 38, 42 of the clips 46, 48 prevent the clips from inadvertently becoming detached, but still allow easy tool-free manual release by the snowboarder.

A further alternative to the first hook 24 is a t-bar 50 formed of rigid material. The t-bar 50 is for use in connection with the t-shaped slot 34 or its equivalent.

Figure 5:
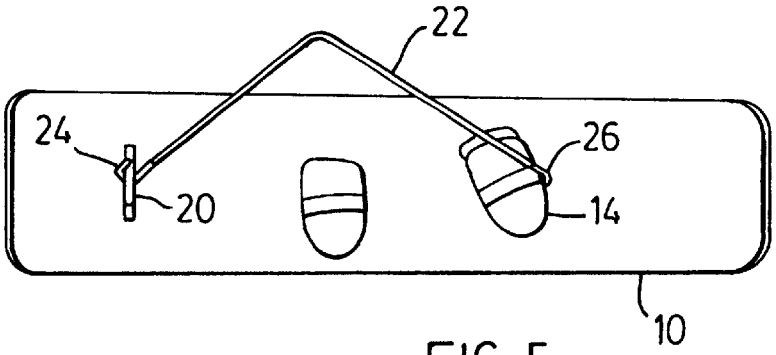
FIG. 5 shows a snowboard tether according to the present invention in use as a carrying strap.

Reference is now made to FIG. 5 which shows the snowboard tether 12 in use as a carrying strap. The first hook 24 is engaging the fastener 20 and the second hook 26 is engaging the front foot binding 14. In this configuration, the length of substantially non-elastic material 22 acts as a carrying strap for the snowboard 10. The second hook 26 could be adapted to engage any other appropriate portion of the snowboard 10. Alternatively, an additional fastener similar to the fastener 20 could be mounted on the upper surface of the front portion of the snowboard 10 to allow for attachment of the second hook 26 when the snowboard tether 12 is in use as a carrying strap.

Reference is now made to FIGS. 6(*a*) to (*d*) which show an embodiment of a fastener 80 that incorporates a storage feature. The fastener is comprised of a mounting piece 52, mounting bolts 53, an inverted U-shaped fastener loop 54, support bars 56, storage mounting plate 58, storage rivets 60 and a storage container 64.

Figure 6A:
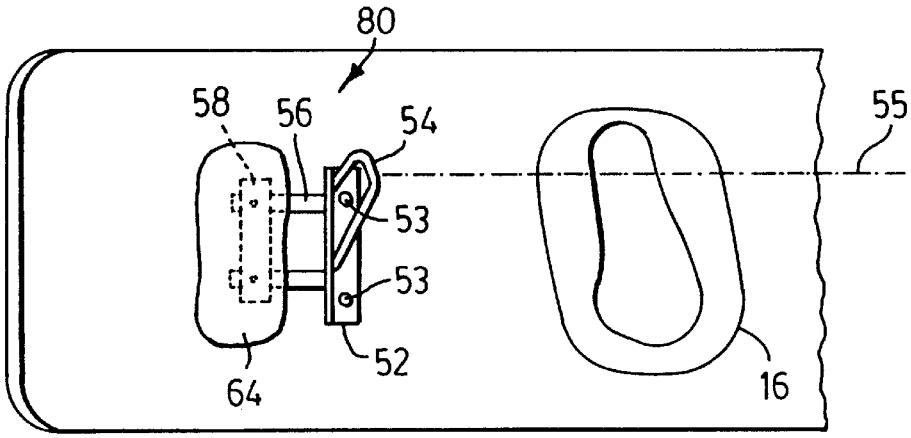
FIGS. 6(*a*), (*b*) and (*c*) show a top view, side view and front view, respectively, of a fastener according to the present invention that incorporates a storage element.
Figure 6B:
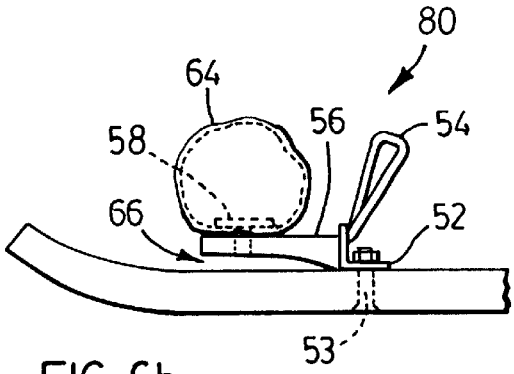
Figure 6C:
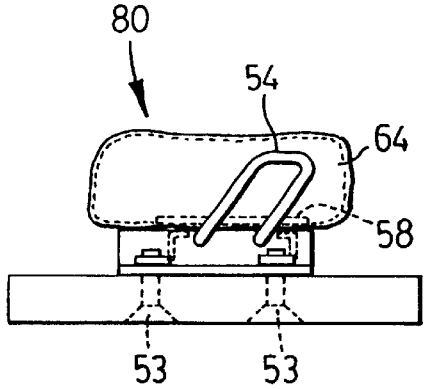
Figure 6D:
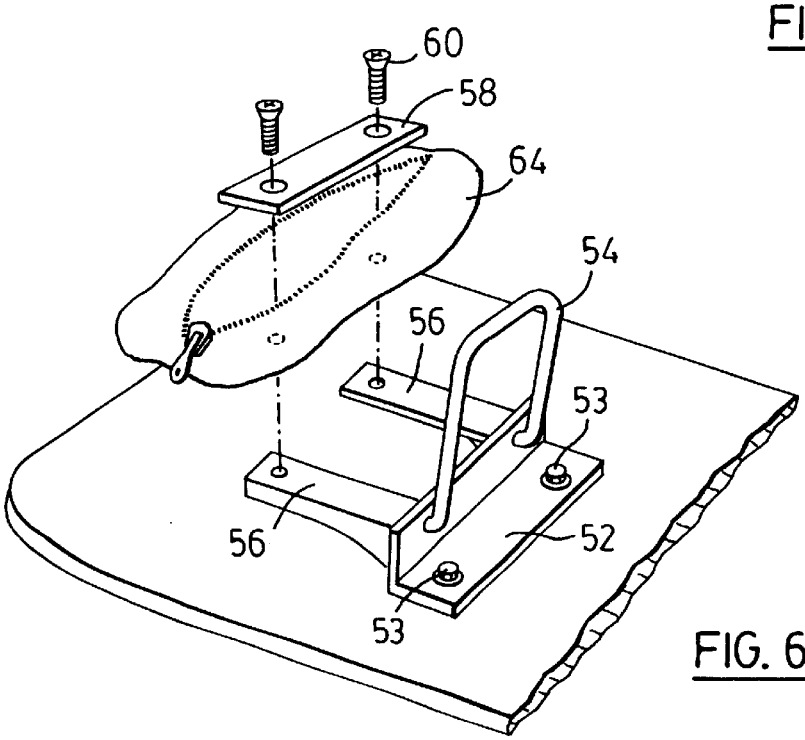

The mounting piece 52 is a length of angle iron affixed to the snowboard 10 by way of the counter-sunk mounting bolts 53. Welded to the mounting piece and extending upwards is the fastener loop 54. The fastener loop 54 is for engaging the first hook 24. The fastener 80 is preferably configured such that the first hook 24 engages the fastener loop 54 at a point along the longitudinal axis 55 parallel to the length of the snowboard 10 and passing through the back foot binding 16 at the point where the heel of the snowboard user is located. If the first hook 24 and the fastener 20 are engaged along that axis, the torsional force perpendicular to the axis of the board caused by the downward force of the snowboard user's back foot is minimized. As can be seen in FIG. 6*c*, the fastener loop 54 is angled towards the heel side of the board so that the tether will support the board along axis 55. Thus, the contact point between the fastener loop 34 and the tether is closer to the heel side of the board than the toe side.

The support bars 56 are lengths of angle iron mounted to the mounting piece 52 and shaved or configured such that they provide a clearance 66 between the support bars 56 and the snowboard 10. This ensures that the snowboard 10 retains its operational flexibility.

The storage container 64 is mounted to the support bars 56 (which function as a support frame for the storage container) by way of the storage mounting plate 58 and the storage rivets 60. The storage container 64 may be any container but is preferably a zippered nylon bag adapted to contain a beverage bottle. This allows the snowboard user to carry a water bottle on the snowboard 10.

Various alternatives exist for incorporating a storage feature into the fastener 80 and will be within the understanding of those skilled in the art.

Advantageously, the snowboard tether 12 according to the present invention supports the rear of the snowboard during the course of a chair-lift ride so as to enable a snowboard user to re-harness his or her back foot to the snowboard and to provide support for the weight of the board during the ride. A further advantage of the snowboard tether 12 according to the present invention is its usefulness as a carrying strap. Additionally, the fastener 20 element according to the present invention provides storage for personal belongings. Although the tether 12 has been described above as being of non-elastic material, it will be appreciated that elastic material could also be used, although care would have to be taken by the user to avoid "snap back" accidents.

The tether strap and fastener of the present invention could be sold with an original snowboard with the fastener pre-mounted to the snowboard, or could be provided as an after-market product as a kit, including instructions for mounting the fastener to the snowboard using one or more of the methods noted above, or other alternative mounting methods.

The present invention may be embodied in other specific forms without departing from the spirit or essential characteristics thereof. Certain adaptations and modifications of the invention will be obvious to those skilled in the art. Therefore, the above-discussed embodiments are considered to be illustrative and not restrictive, the scope of the invention being indicated by the appended claims rather than the foregoing description, and all changes which come within the meaning and range of equivalency of the claims are therefore intended to be embraced therein.

I claim:

1. A snowboard tether for supporting the weight of a snowboard while the user is riding a chair-lift, the snowboard having front, middle and rear portions and an upper face, the snowboard having front and rear foot bindings affixed to the upper face of the middle portion of the snowboard, the snowboard tether comprising:

(a) a fastener, said fastener being affixed to the upper face of the rear portion of the snowboard, rearward of the rear binding; and (b) a strap, a first manually releasable attachment device located at one end of said strap for securing said strap to said fastener and a second manually releasable attachment device located at the other end of said strap for securing said strap to the chair-lift such that the chair-lift provides support for the snowboard.

2. A snowboard tether as in claim 1, wherein said fastener comprises an inverted U-shaped handle upon which to attach a manually-releasable attachment device.

3. A snowboard tether as in claim 1, wherein said fastener comprises an eye-bolt.

4. A snowboard tether as in claim 1, wherein said fastener comprises a t-shaped slot molded into the snowboard and said first manually-releasable attachment device comprises a t-shaped bar for engaging said slot.

5. A snowboard tether as in claim 1, wherein said first manually-releasable attachment device comprises a hook.

6. A snowboard tether as in claim 1, wherein said first manually-releasable attachment device comprises a hook portion and a spring-biased closure portion biased against said hook portion in a closed position for preventing accidental removal of said first manually-releasable attachment device from said fastener.

7. A snowboard tether as in claim 1, wherein the rear binding includes a heel portion closer to a heel side of the snowboard than an opposite toe side of the snowboard, the fastener being configured so that the point at which it is supported by the strap during use is closer to the heel side of the snowboard than the toe side of the snowboard.

8. A snowboard according to claim 7 wherein the fastener includes an inverted U-shaped portion angled to extend towards the heel side of the snowboard as the fastener extends away from the upper face of the snowboard.

9. A snowboard tether as in claim 1 further comprising a storage container affixed to said fastener.

10. A snowboard tether as in claim 9, wherein said storage container comprises a nylon bag.

11. A snowboard tether as in claim 10, wherein said storage container comprises a nylon bag adapted to carry a bottle.

12. A snowboard tether as in claim 1, wherein the fastener includes a support frame for supporting a storage container, the support frame extending substantially parallel to, but spaced apart from, the upper face of the snowboard.

13. A method of supporting the weight of a snowboard while the user is riding a chair-lift so as to enable the user to harness his or her back foot to the snowboard while riding the chair-lift, the snowboard having front, middle and rear portions and an upper face, the snowboard having front and rear foot bindings affixed to the upper face of the middle portion of the snowboard, comprising the steps of:

(a) attaching a manually-releasable attachment device provided on a first end of a strap to a fastener located on the upper face of the rear portion of the snowboard;

(b) attaching a second end of said strap to the chair-lift so that the rear portion of the snowboard is secured to the chair-lift;

(c) harnessing the user's back foot into the rear foot binding during the course of the chair-lift ride; and (d) detaching the strap from the chair-lift and said fastener prior to the end of the chair-lift ride.

14. A kit of parts for assembling a snowboard tether for supporting the weight of a snowboard while the user is riding a chair-lift so as to enable the user to harness his or her back foot to the snowboard while riding the chair-lift, the snowboard having, front, middle and rear portions and an upper face, the snowboard having front and rear foot bindings affixed to the upper face of the middle portion of the snowboard, the kit comprising:

(a) a fastener, said fastener being configured to be affixed to the upper face of the rear portion of the snowboard; and (b) a strap, a first manually-releasable attachment device located at one end of said strap for securing said strap to said fastener and a second manually releasable attachment device located at the other end of said strap for securing said strap to the chair-lift such that the chair-lift provides support for the weight of the snowboard and any downward forces exerted upon the snowboard.

* * * * *